US007025227B2

(12) United States Patent
Oliver et al.

(10) Patent No.: US 7,025,227 B2
(45) Date of Patent: Apr. 11, 2006

(54) ELECTRONIC SOAP DISPENSER

(75) Inventors: Steven R. Oliver, Chicago, IL (US); Richard A. Nortier, Westchester, IL (US)

(73) Assignee: Sloan Valve Company, Franklin Park, IL (US)

( * ) Notice: Subject to any disclaimer, the term of this patent is extended or adjusted under 35 U.S.C. 154(b) by 183 days.

(21) Appl. No.: 10/672,650

(22) Filed: Sep. 26, 2003

(65) Prior Publication Data

US 2005/0087557 A1 Apr. 28, 2005

(51) Int. Cl.
*B67D 5/008* (2006.01)

(52) U.S. Cl. ..... 222/61; 222/180; 222/333; 222/372

(58) Field of Classification Search ..... 222/52, 222/61, 63, 180, 333, 383.1, 372; 251/129.04
See application file for complete search history.

(56) References Cited

U.S. PATENT DOCUMENTS 4,938,384 A * 7/1990 Pilolla et al. ..... 222/52
4,953,236 A * 9/1990 Lee et al. ..... 4/668
5,031,258 A * 7/1991 Shaw ..... 4/623
5,215,216 A * 6/1993 Van Marcke ..... 222/1
5,305,915 A 4/1994 Kamycz et al.
5,548,119 A 8/1996 Nortier
5,549,487 A 8/1996 Nortier
5,555,912 A * 9/1996 Saadi et al. ..... 137/801
5,625,908 A 5/1997 Shaw
5,632,414 A * 5/1997 Merriweather, Jr. ..... 222/52
5,781,942 A 7/1998 Allen
5,829,636 A 11/1998 Vuong
5,950,983 A 9/1999 Jahrling
5,966,753 A 10/1999 Gauthier
6,104,302 A 8/2000 Vuong
6,161,814 A 12/2000 Jahrling
6,202,980 B1 * 3/2001 Vincent et al. ..... 251/129.04
6,206,241 B1 * 3/2001 Terrell et al. ..... 222/63
6,467,651 B1 10/2002 Muderlak et al.
6,557,729 B1 5/2003 Gauthier
6,581,801 B1 6/2003 Gauthier
6,691,893 B1 2/2004 Gauthier

* cited by examiner

*Primary Examiner*—Melvin A. Cartagena
(74) *Attorney, Agent, or Firm*—Cook, Alex, McFarron, Manzo, Cummings & Mehler, Ltd.

(57) ABSTRACT

A liquid soap dispenser includes a housing, a shank that engages a base of the housing, a soap path retainer disposed in the interior of the housing, a shank adapter disposed in the shank, and an infrared sensor to sense the presence of a user. A generally continuous passageway is defined through the shank adapter and the soap path retainer such that an elongated soap delivery tube of a liquid soap reservoir may be inserted through the passageway from the bottom of the soap dispenser to the spout end. The reservoir may be attached to the bottom end of the shank adapter. The soap path retainer is preferably formed of complementary halves, such as by plastic injection molding, that mate together to provide a curved passageway from near the base of the housing to the soap dispensing end and to support the sensor assembly.

18 Claims, 5 Drawing Sheets

ELECTRONIC SOAP DISPENSER

FIELD OF THE INVENTION

The present invention relates generally to the field of electronic plumbing devices. More particularly, the present invention relates to apparatus for electronically dispensing liquid soap.

BACKGROUND OF THE INVENTION

Electronic faucets are known to the prior art that sense the presence of a person to initiate the flow of water, such as when a user's hands are placed under the faucet. Such electronic faucets are especially popular in public buildings and in health institutions because users do not have to come into contact with the faucet to activate the flow of water. There is therefore less likelihood that bacteria will be transferred between users of the faucet.

Various types of manually-operated liquid soap dispensers also exist in the prior art. Since such manually-operated dispensers require physical contact with the dispenser, such as by actuating an internal manual pump, multiple users come into contact with the dispenser. Additionally, such manually-operated liquid soap dispensers do not match the esthetics of the other plumbing devices.

U.S. Pat. No. 6,467,651 to Muderlak et al. and assigned to Technical Concepts, L.P., discloses, inter alia, a module for automatically dispensing fluid soap. This module consists of a container, a pump mechanism, a pump actuator and a delivery tube. However, such soap dispensers are frequently located in public buildings where there is an increased risk of damage or destruction to the soap dispenser, such as due to vandalism. Vandalism can be a significant problem in public buildings, especially in generally isolated areas such as is often the case with restrooms.

U.S. Pat. Nos. Des. 341,741 and Des. 341,875, to both to Allen et al. and both issued on Nov. 30, 1993, illustrate the appearance electronic liquid soap dispensers, with and without an electronically controlled faucet. Both of these design patents are assigned to the assignee of the present invention. However, neither of these design patents discloses any internal structure, such as how the housing of the electronic liquid soap dispenser mates with the soap dispensing apparatus.

There has been a long-felt need for an electronic liquid soap dispenser that offers the benefits of electronic faucets and that is designed to have the appearance and esthetics of an electronic faucet, such as an electronic soap dispenser that matches the style and decor of the other plumbing fixtures.

Accordingly, it is a general object of the present invention to provide a new and improved liquid soap dispenser.

Another object of the present invention is to provide a liquid soap dispenser with greater durability.

Yet another object of the present invention is to provide a liquid soap dispenser that complements other adjacently located plumbing fixtures, such as electronic faucets.

A further object of the present invention is to provide a smooth and continuous pathway for the soap delivery tube from a soap reservoir of a liquid soap dispenser.

A still further object of the present invention is to provide a liquid soap dispenser with a metal housing to improve resistance to vandalism of the like.

BRIEF SUMMARY OF THE INVENTION

This invention is directed to apparatus for automatically dispensing liquid soap in response to the detection of a user in proximity to the dispenser.

The liquid soap dispenser mates with a liquid soap reservoir, with an elongated soap dispensing tube extending from the reservoir, and a pump for pumping liquid soap through the soap dispensing tube. A housing of the soap dispenser has a base end and a spout end and has an accessible interior through a removable face plate. The face plate has a window for a sensor assembly disposed behind the window. The sensor assembly detects the presence of a user near the soap dispenser and sends signals to activate the pump to supply liquid soap from the reservoir through the soap dispensing tube. A shank engages the base of the housing to secure the base end of the housing to a surface.

A soap path retainer is disposed in the interior of the housing between the base end and the spout end, with a generally cylindrical passageway defined in the retainer between said ends. The passageway is curved through more than 90 degrees between the base end and the spout end, and preferably in the range of 120 to 150 degrees. The soap path retainer may be formed from complementary halves, as by plastic injection molding techniques, with locking means provided on the complementary halves to lock or secure the halves to each other. The soap path retainer also has a sensor base for receiving a sensor frame to support the sensor assembly near the window in the face plate.

A shank adapter is disposed in the shank. The shank adapter has a generally cylindrical passageway defined through the adapter from the bottom end to the top end. The bottom end of the soap path retainer has an enlarged base portion with an opening defined therein for inserting a locking ring, or the like, to secure the top end of the shank adapter to the base portion of the soap path retainer. The passageway through the shank adapter and the passageway through the soap path retainer are then in general axial alignment so that the elongated soap dispensing tube can be inserted into both passageways. Preferably, the elongated tube is of sufficient length that it extends just past the spout end of the soap path retainer such that dispensed soap does not remain at the spout end of the retainer or in the passageway thereof. The soap reservoir and the pump may be secured to the bottom end of the shank adapter.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the figures in which like reference numerals identify like elements, and in which:

DESCRIPTION OF THE PREFERRED EMBODIMENT

Figure 1:
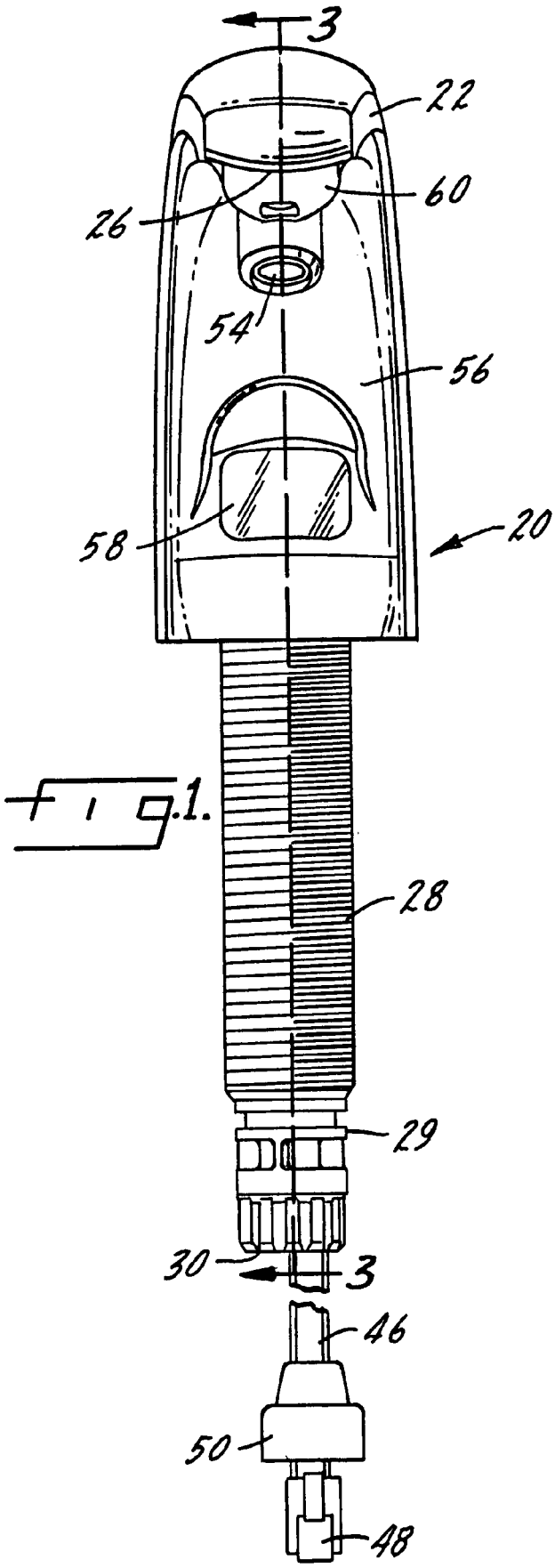
FIG. 1 is a front elevational view of an electronic soap dispenser constructed in accordance with the present invention.

The present invention of an electronic soap dispenser, generally designated 20, to dispense liquid soap is shown in FIG. 1.

Figure 2:
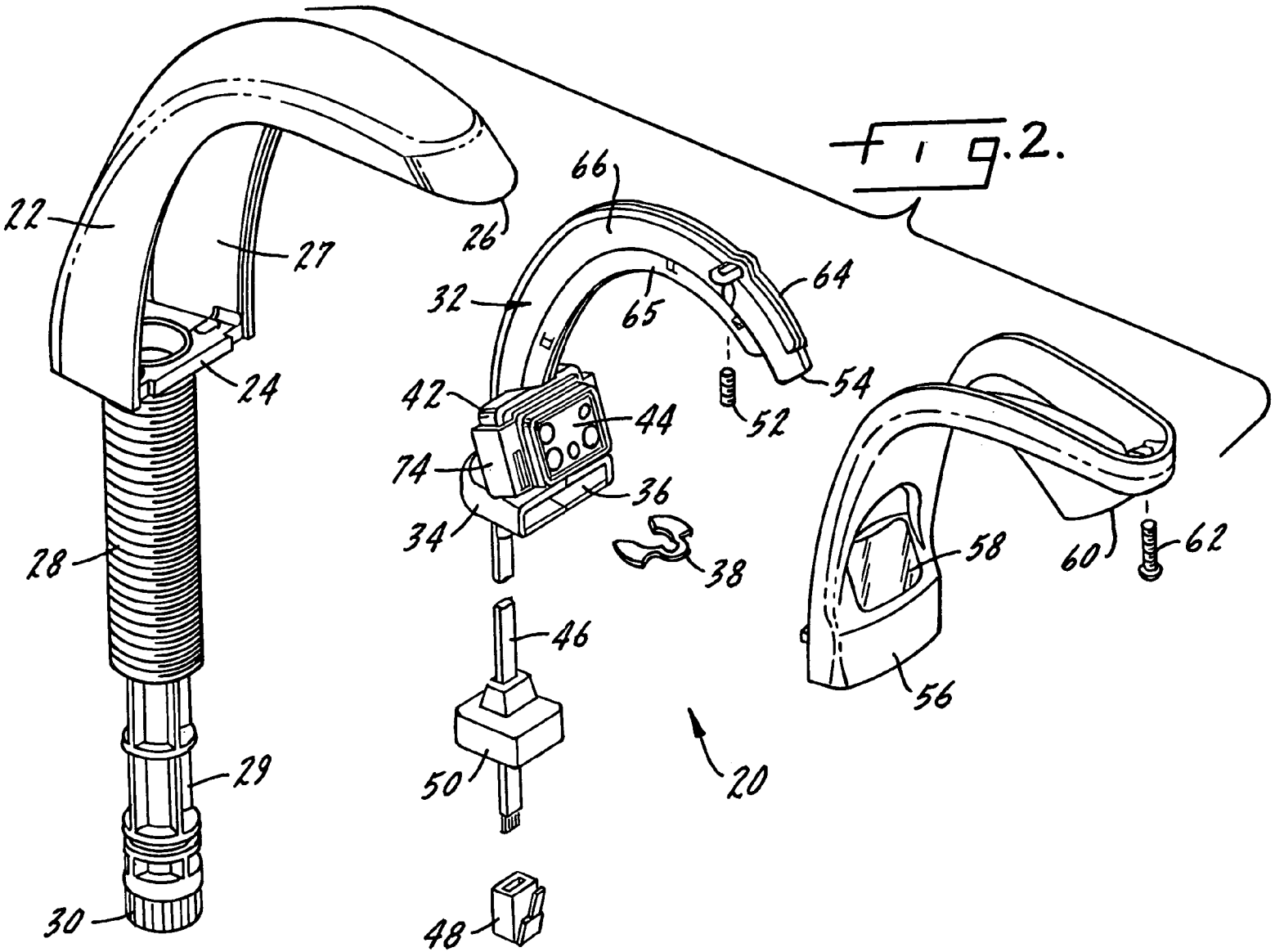
FIG. 2 is an exploded view of the electronic soap dispenser of FIG. 1 illustrating the various components thereof.

As can be seen in the exploded view of FIG. 2, soap dispenser 20 consists of a plurality of cooperating parts or components. A spout housing 22 is of generally curved or arcuate shape extending from a base 24 to a frontal edge 26 that extends above and forwardly with respect to the base 24. Spout housing 22 has a generally open front that defines an internal cavity 27. A threaded shank 28 engages corresponding threads in the base 24 of spout housing 22, for attachment of the spout assembly 20 to a sink or the like, such as with a threaded nut from the underside of the sink in a manner known to the art. A shank adapter 29 is received in the shank 28. A lower end 30 of shank adapter 29 is suited for receiving and holding a reservoir of liquid soap, such as a reservoir 40 shown in FIG. 4.

A soap path retainer 32 has a generally semicircular base portion 34 with an open slot 36 defined in the front of the base portion 34, and an opposite soap dispensing end 54. When the soap path retainer 32 is disposed in the internal cavity 27 of the spout housing 22, a retaining ring 38 may be inserted into slot 36 to engage the upper end of shank adapter 29 to retain the shank adapter 29 within the shank 28. Soap path retainer 32 may be secured within the cavity 27 of spout housing 22 by a threaded fastener, such as a set screw 52 or the like.

Figures 3, 4:
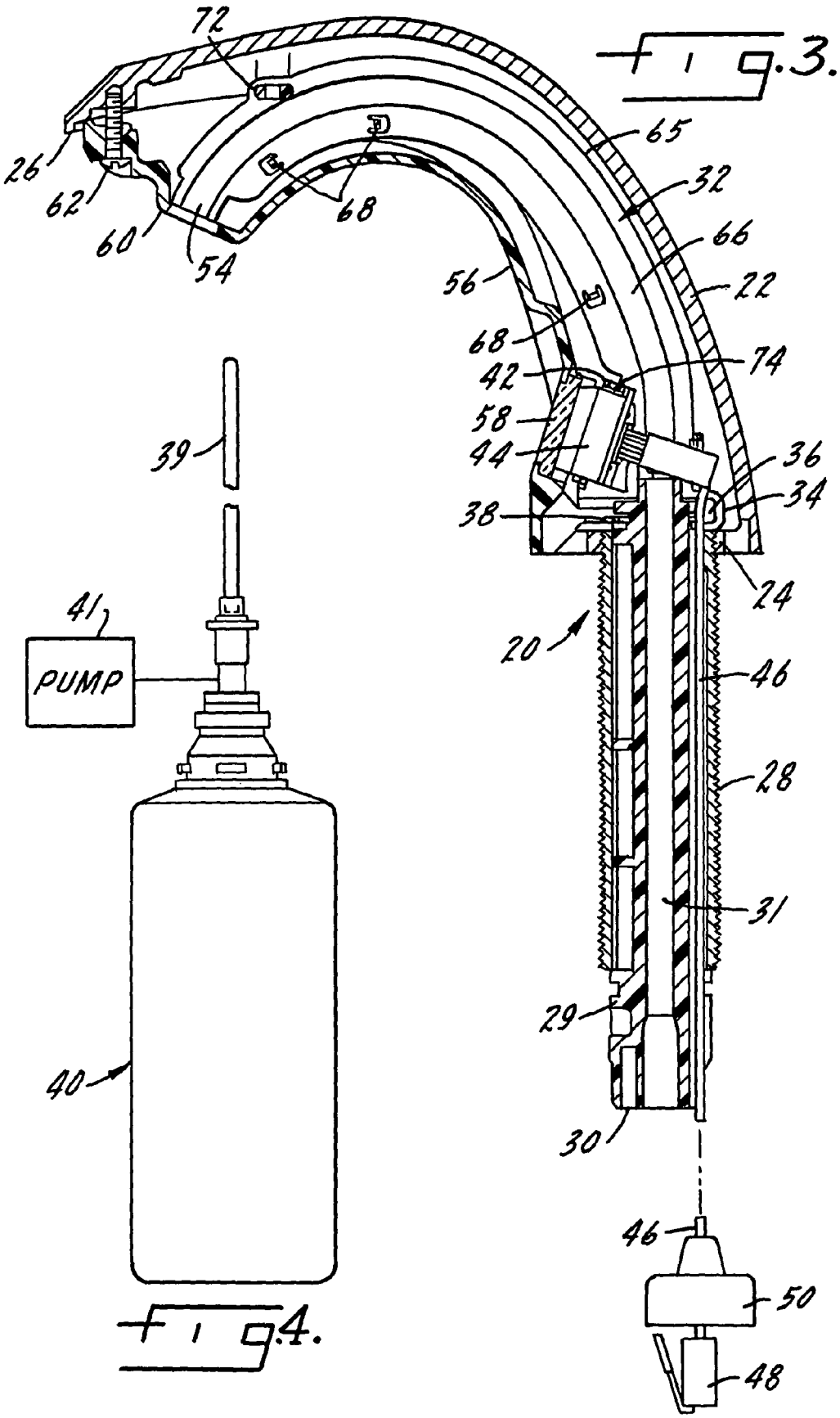
FIG. 3 is a cross-sectional view of the electronic soap dispenser of FIGS. 1 and 2 taken along the section line 3—3 in FIG. 1.
FIG. 4 is an elevational view of a liquid soap reservoir, including a pump in diagrammatic form, for use in conjunction with the liquid soap dispenser of FIGS. 1–3.

A sensor base 42, for supporting and retaining a sensor assembly 44, is disposed above the base portion 34 of the soap path retainer 32. As can be seen in FIG. 3, an electrical cable 46 extends from the backside of sensor assembly 44 downwardly between the shank 28 and the shank adapter 29 past the bottom end 30 of shank adapter 29. A groove is defined in the backside of shank adapter 29 to provide a path for the cable 46 between shank 28 and shank adapter 29. Cable 46 is preferably a flat ribbon cable, such as the type commonly used for telephone cords, and provides electrical paths for providing power to sensor assembly 44 and for receiving electrical signals from the sensor assembly 44. Cable 46 terminates at an electrical connector 48, which may be a standard connector of the RJ-11 type commonly used for telephones. A boot 50, of rubber or the like, may be used to keep connector 48 from becoming exposed to moisture under the sink.

Electronic circuitry for receiving the sensor signals from connector 48 and for activating the pump 41 to dispense liquid soap from the reservoir 40 is known to the art. For example, U.S. Pat. No. 6,467,651 represents one embodiment of such circuitry.

An access plate 56 is of generally curved or arcuate shape encloses the front of spout housing 22 when the soap path retainer 32 is inserted into the cavity 27. A window 58 provided in access plate 56 enables sensor assembly 44 to sense the presence of a user's hands in proximity to the soap dispenser. A downwardly extending spout portion 60, which is part of the throat plate, has an aperture through which the soap dispensing end 54 of soap path retainer 32 extends to deliver soap from the soap dispenser. A threaded fastener 62 secures the face plate 56 to the spout housing 22.

Figure 7:
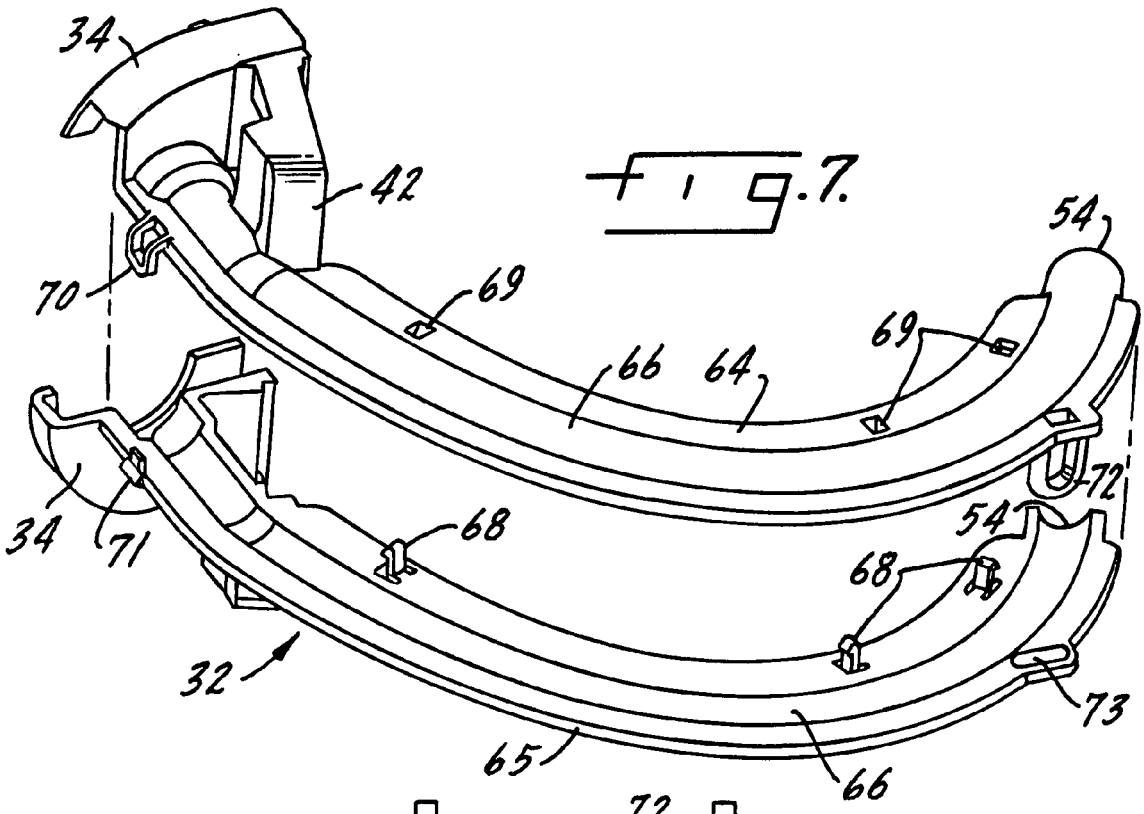
FIG. 7 is a exploded view of the complementary halves that together form the soap path retainer shown in FIGS. 5 and 6.
Figure 8:
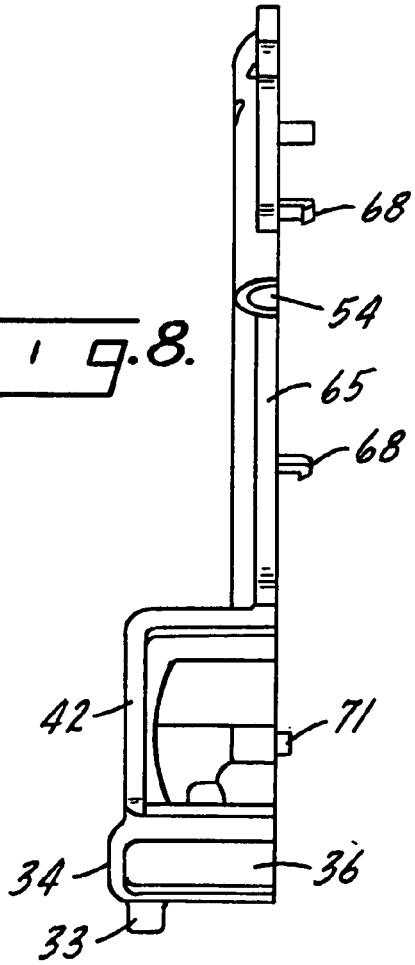
FIG. 8 is front elevational view of one of the halves of the soap path retainer shown in FIGS. 5–7.
Figure 9:
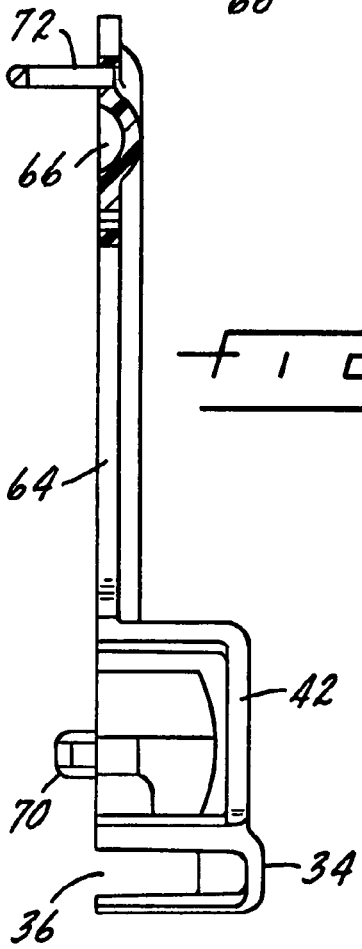
FIG. 9 is a front elevational view of the opposite half of the soap path retainer to that shown in FIG. 8.

FIGS. 5 through 9 provide various views of the structure of the soap path retainer assembly 32. As illustrated in FIGS. 7–9, soap path retainer assembly 32 can be fabricated as two complementary halves 64 and 65. For example, the soap path retainer halves 64–65 may be fabricated from various plastic materials by plastic injection molding or any other suitable techniques. Halves 64–65 each define one-half of the semicircular base portion 34, the slot 36, and the sensor base 42 to which the sensor retainer frame attaches. Each of halves 64–65 also provide one-half of an elongated and curved tube or channel 66 defined in the halves from the semicircular base 34 to the soap dispensing end 54. However, portions of the tube or channel 66 may also be linear, such as that portion of the channel 66 defined in the halves 64–65 near the base portion 34.

The soap path retainer halves 64–65 are secured to each other when assembled or snapped together. As seen in FIGS. 7 and 8, a plurality of locking tabs 68 project from the inner surface of soap path retainer half 65 and pass through apertures 69 defined through the opposite half 64 to lock the halves 64–65 to each other. A clasp 70 disposed along an opposite edge of soap retainer half 64 also passes over and locks over a tab 71 disposed along an edge of half 65 to provide additional means of securing the halves 64–65 to each other. At the same time, and elongated eyelet 72, which is disposed inwardly on an edge of half 64, passes through an aperture 73 that is disposed at a corresponding position along an edge of half 65. Set screw 52 in FIG. 2 passes through the eyelet 72 to secure the soap path retainer 32, including the two halves 64–65, in the spout housing 22. One or more centering pegs 33 may be disposed on the bottom surface of soap path retainer 32 to center the soap path retainer with respect to the base 24 of the spout housing 22.

Preferably, the passageway 66 in soap path retainer 32 curves through at least 90 degrees such that soap is dispensed in a downward direction from the soap dispensing end 54. Preferably, passageway 66 curves through about 120 to 150 degrees, as measured from the direction of the passageway at the base portion 34 to the direction of the passageway 66 at the soap dispensing end 54.

Figures 5, 6, 10, 11:
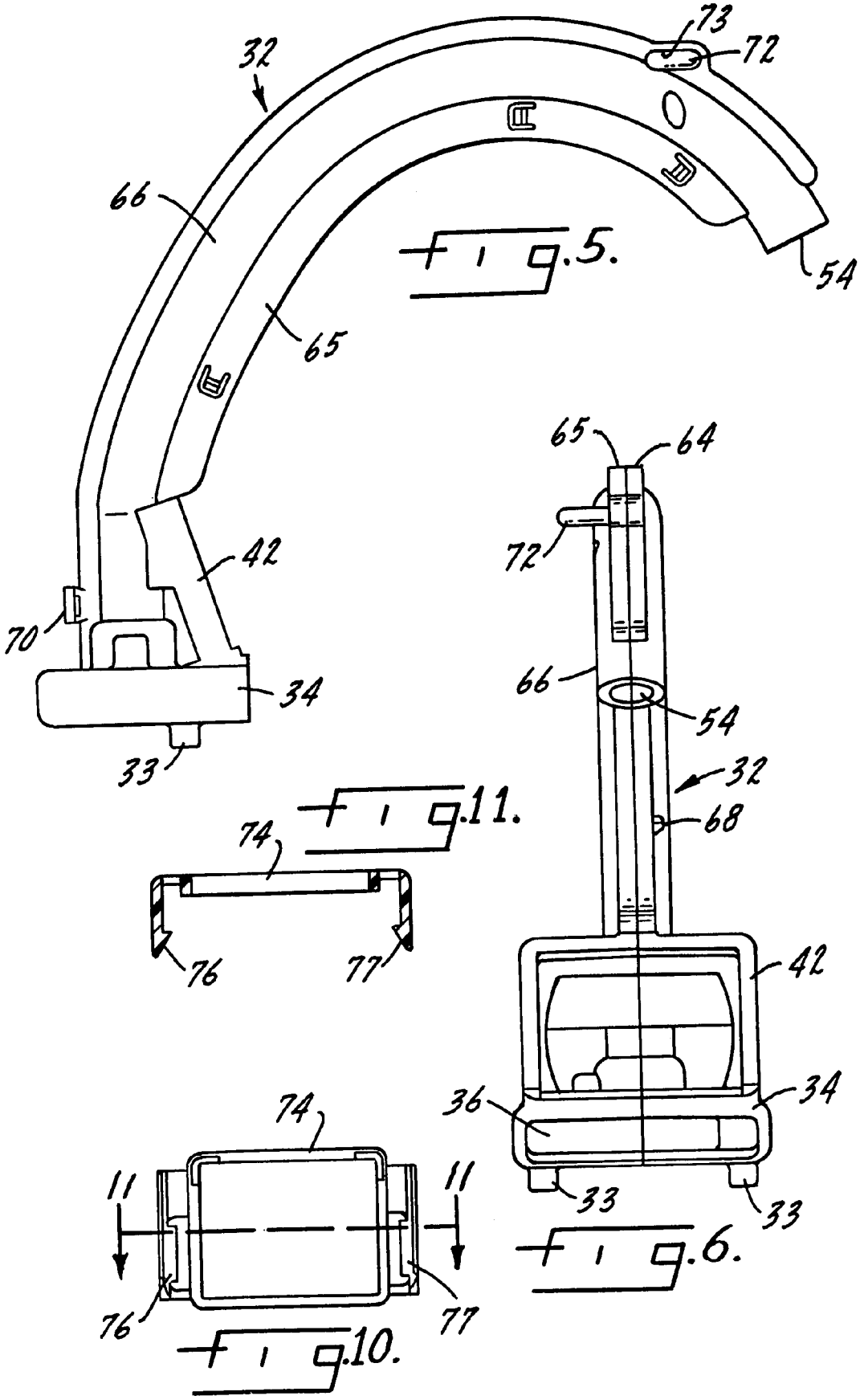
FIG. 5 is a side elevational view of a soap path retainer that is disposed in the interior of the liquid soap dispenser of the present invention.
FIG. 6 is a front elevational view of the soap path retainer shown in FIG. 5.
FIG. 10 is a top plan view of a sensor retaining frame for housing the sensor assembly near the base of the soap path retainer, as also seen in FIG. 2.
FIG. 11 is a cross-sectional view of the sensor retaining frame of FIG. 10 taken along section line 11—11 in FIG. 10 to illustrate the opposing arms that secure the sensor retaining frame to the soap path retainer.

A sensor retaining frame 74 in FIG. 10 has a generally hollow interior to house the sensor assembly 44 shown in FIG. 2. As is known in the art, sensor assembly 44 transmits an infrared signal to sense the presence of a user's hands near the soap dispenser 20, and determines the presence of the user's hands by detecting reflected signals. Such infrared sensors are also commonly used in electronic faucets. As seen in FIG. 11, sensor retaining frame 74 has a pair of opposing locking arms 76–77 to engage and lock onto the sensor base 42 of the soap path retainer 32.

When all of the components of the soap dispenser 20 are assembled as shown in FIG. 3, a generally cylindrical channel or passageway 31 extending longitudinally and axially through shank adapter 29 is in generally axial alignment with the cylindrical passageway 66 extending lengthwise through the soap path retainer 32. The liquid soap reservoir 40 has a flexible and elongated dispensing tube 39 that may be of generally circular cross-section that is of slightly smaller diameter than that of passageways 31 and 66. Soap dispensing tube 39 may thus be inserted upwardly through passageways 31 and 66 with top of reservoir 40 then secured to the bottom 30 of shank adapter 29. Preferably, soap dispensing tube 39 is of sufficient length that it extends entirely through passageways 31 and 66 and just past the end 54 of the retainer 32 such that soap residues are not left in passageway 66 or at the soap dispensing end 54 of retainer 32. Soap dispenser 20 may be mated with any appropriate liquid soap reservoir 40 and pump 41, other than those shown in FIG. 4.

While particular embodiments of the invention have been shown and described, it will be obvious to those skilled in the art that changes and modifications may be made therein without departing from the invention in its broader aspects.

The invention claimed is:

1. A liquid soap dispenser for mating with a liquid soap reservoir, said reservoir having an elongated soap dispensing tube extending from the reservoir, and a pump for pumping liquid soap through the soap dispensing tube, said liquid soap dispenser comprising:

a housing with a base end and a spout end;

a shank for engaging the housing and for securing the base end of the housing to a surface;

a soap path retainer disposed in said housing, said soap path retainer having a generally cylindrical passageway extending from near the base end of the housing to the spout end, said soap path retainer further comprising two complementary halves that are mated together;

a shank adapter disposed in said shank, said shank adapter having a generally cylindrical passageway defined therethrough, said shank adapter having a bottom end for securing the liquid soap reservoir to the soap dispenser;

said passageway in the shank adapter and the passageway in the soap path retainer in general alignment to receive the elongated soap dispensing tube therein;

a sensor for detecting the presence of a user near the soap dispenser and for sending signals to activate the pump to supply liquid soap through the soap dispensing tube upon detecting the presence of a user.

2. The liquid soap dispenser as claimed in accordance with claim 1, said passageway in the soap path retainer is curved through more than 90 degrees.

3. The liquid soap dispenser as claimed in accordance with claim 2, wherein the passageway in the soap path retainer is curved in the approximate range of 120 to 150 degrees.

4. The liquid soap dispenser as claimed in accordance with claim 1, wherein the two complementary halves of the soap path retainer are formed from plastic.

5. The liquid soap dispenser as claimed in accordance with claim 1, wherein said soap path retainer further comprises a sensor base and a sensor housing for containing the sensor therein, said sensor housing secured to the sensor base of the soap path retainer.

6. The liquid soap dispenser as claimed in accordance with claim 1, wherein said housing is generally curved from the base end to the spout end.

7. The liquid soap dispenser as claimed in accordance with claim 1, wherein said housing has an open front surface and a face plate for covering the open front surface and for providing access to the interior of said housing.

8. The liquid soap dispenser as claimed in accordance with claim 7, wherein said face plate has a window for said sensor.

9. The liquid soap dispenser as claimed in accordance with claim 1, wherein said soap path retainer has a base portion with an aperture, said liquid soap dispenser further comprising locking means disposed in said aperture for securing a top end of the shank adapter to the soap path retainer.

10. A liquid soap dispenser for mating with a liquid soap reservoir, said reservoir having an elongated soap dispensing tube extending from the reservoir, and a pump for pumping liquid soap through the soap dispensing tube, said liquid soap dispenser comprising:

a housing with a base end and a spout end;

a shank for engaging the housing and for securing the base end of the housing to a surface;

a soap path retainer disposed in said housing, said soap path retainer having a generally cylindrical passageway extending from near the base end of the housing to the spout end, said soap path retainer further comprising two complementary halves that are secured together;

a shank adapter disposed in said shank, said shank adapter having a generally cylindrical passageway defined therethrough, said shank adapter having a bottom end for securing the liquid soap reservoir to the soap dispenser;

said passageway in the shank adapter and the passageway in the soap path retainer in general alignment to receive the elongated soap dispensing tube therein;

a liquid soap reservoir with an elongated soap dispensing tube extending from the reservoir; said elongated soap dispensing tube disposed in and through the passageway in the shank adapter and the passageway in the soap path retainer;

a pump for pumping liquid soap from the reservoir through the elongated soap dispensing tube; and a sensor for detecting the presence of a user near the soap dispenser and for sending signals to activate the pump to supply liquid soap through the soap dispensing tube upon detecting the presence of a user.

11. The liquid soap dispenser as claimed in accordance with claim 10, said passageway in the soap path retainer is curved through more than 90 degrees.

12. The liquid soap dispenser as claimed in accordance with claim 11, wherein the passageway in the soap path retainer is curved in the approximate range of 120 to 150 degrees.

13. The liquid soap dispenser as claimed in accordance with claim 10, wherein the two complementary halves of the soap path retainer are formed from plastic.

14. The liquid soap dispenser as claimed in accordance with claim 10, wherein said soap path retainer further comprises a base portion and a sensor housing for containing the sensor therein, said sensor housing secured to the base portion of the soap path retainer.

15. The liquid soap dispenser as claimed in accordance with claim 10, wherein said housing is generally curved from the base end to the spout end.

16. The liquid soap dispenser as claimed in accordance with claim 10, wherein said housing has an open front surface and a face plate for covering the open front surface and for providing access to the interior of said housing.

17. The liquid soap dispenser as claimed in accordance with claim 16, wherein said face plate has a window for said sensor.

18. The liquid soap dispenser as claimed in accordance with claim 10, wherein said soap path retainer has a base portion with an aperture, said liquid soap dispenser further comprising locking means disposed in said aperture for securing a top end of the shank adapter to the soap path retainer.

* * * * *